US011384303B2

(12) United States Patent
Ettefaghi et al.

(10) Patent No.: US 11,384,303 B2
(45) Date of Patent: Jul. 12, 2022

(54) THREE-PHASE FUEL COMPOSITION

(71) Applicants: Ehsanollah Ettefaghi, Tehran (IR); Alimorad Rashidi, Tehran (IR); Barat Ghobadian, Tehran (IR); Mojtaba Askarieh, Tehran (IR); Davood Mohammady Maklavany, Tehran (IR); Saeed Askari, Shiraz (IR)

(72) Inventors: Ehsanollah Ettefaghi, Tehran (IR); Alimorad Rashidi, Tehran (IR); Barat Ghobadian, Tehran (IR); Mojtaba Askarieh, Tehran (IR); Davood Mohammady Maklavany, Tehran (IR); Saeed Askari, Shiraz (IR)

(73) Assignees: TARBIAT MODARES UNIVERSITY, Tehran (IR); EHSANOLLAH ETTEFAGHI, Tehran (IR); Alimorad Rashidi, Tehran (IR); Barat Ghobadian, Tehran (IR)

( * ) Notice: Subject to any disclaimer, the term of this patent is extended or adjusted under 35 U.S.C. 154(b) by 0 days.

(21) Appl. No.: 17/206,532

(22) Filed: Mar. 19, 2021

(65) Prior Publication Data

US 2021/0230493 A1 Jul. 29, 2021

Related U.S. Application Data

(60) Provisional application No. 63/066,172, filed on Aug. 15, 2020.

(51) Int. Cl.
*C10L 3/10* (2006.01)
*C10L 1/30* (2006.01)

(52) U.S. Cl.
CPC ..... *C10L 3/10* (2013.01); *C10L 1/305* (2013.01); *C10L 2250/00* (2013.01); *C10L 2290/14* (2013.01); *C10L 2290/18* (2013.01); *C10L 2290/20* (2013.01); *C10L 2290/24* (2013.01); *C10L 2290/548* (2013.01)

(58) Field of Classification Search
CPC ..... C10L 3/10; C10L 1/305; C10L 2290/548; C10L 2250/00; C10L 2290/20; C10L 2290/14; C10L 2290/24; C10L 2290/18
See application file for complete search history.

(56) References Cited

U.S. PATENT DOCUMENTS 6,540,936 B1 * 4/2003 Takagi ..... B01D 53/1493 252/181.1
2011/0265370 A1 * 11/2011 Avila ..... C10L 1/328 44/302

FOREIGN PATENT DOCUMENTS

WO WO2018203796 * 11/2018

* cited by examiner

*Primary Examiner* — Cephia D Toomer
(74) *Attorney, Agent, or Firm* — Bajwa IP Law Firm; Haris Zaheer Bajwa

(57) ABSTRACT

A three-phase fuel composition may be synthesized by producing a first composition by trapping at least one gas into pores of an adsorbent, producing a coated composition by spray coating a solution on the first composition, and mixing the coated composition with a liquid fuel.

19 Claims, 12 Drawing Sheets

300

400

500

600

700

THREE-PHASE FUEL COMPOSITION

CROSS-REFERENCE TO RELATED APPLICATION

This application claims the benefit of priority from U.S. Provisional patent Application Ser. No. 63/066,172, filed on Aug. 15, 2020, and entitled "THREE-PHASE NANO FUEL (LIQUID-SOLID-GAS)," which is incorporated herein by reference in its entirety.

TECHNICAL FIELD

The present disclosure relates to three-phase fuel compositions and particularly relates to a method for synthesizing a three-phase fuel composition.

BACKGROUND

Fossil fuels are considered as the most common energy resources for various industries. The rising costs of fossil fuels on one hand and the pollution caused by these non-renewable resources on the other hand have encouraged researchers to find a strategy to improve the efficiency of fossil fuels.

Liquid fuels, such as oil are the most commonly-used type of fossil fuels. Liquid fuels have two main shortcomings, namely, low efficiency and high pollutant emissions during combustion. Pollutants may negatively affect the weather and bring about problems, such as global warming, acid rains, and respiratory problems. Main pollutants emitted as a result of liquid fuel combustion include nitrogen oxide, unburned hydrocarbons, carbon dioxide, sulfur oxide, and soot. Moreover, consumption of liquid fuels may rise in response to the low efficiency of liquid fuels. One approach to address the low efficiency of liquid fuels may be redesigning liquid-fuel-burning motors, which may be unnecessarily complex and expensive.

Another approach for addressing the low efficiency of liquid fuels may be enhancing liquid fuels efficiency by adding various metals, metal oxides, and carbon nano structures to liquid fuels. For example, additives such as platinum, cobalt, radium, iridium, nickel, palladium, copper, silver, gold, zinc, aluminum, alumina, calcium oxide, titanium oxide, zirconium dioxide, iron oxides, ruthenium oxide, osmium oxide, cobalt oxide, radium oxide, iridium oxide, nickel oxide, silver oxide, gold oxide, zinc oxide, cerium oxide, carbon dots, carbon nanotubes, and graphene nano sheets may be added to fuels to increase their efficiency by improving air and fuel mixing. However, such additives still show poor efficiency-enhancement properties when used in liquid fuels, which may limit their usage.

One approach to further improve efficiency-enhancement properties of fuel additives may be utilizing nanostructures for storing flammable gases. For example, flammable gases may be stored in three-dimensional metal-organic frameworks. However, developing a safe method for the storage of flammable gases in such three-dimensional structures is crucial. To guarantee safe storage of flammable gases inside additives at room temperature, a coating may be required, which may be flammable when the liquid fuels ignite.

There is, therefore, a need for developing fuel-additive compositions that may be capable of storing flammable gasses. There is further a need for developing a method for producing a three-phase fuel that may allow for a safe storage of flammable gasses within the structure of the three-phase fuel.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description and the drawings.

According to one or more exemplary embodiments, the present disclosure is directed to a method for producing a three-phase fuel composition. An exemplary method may include producing a first composition by trapping at least one gas into pores of an adsorbent. An exemplary method may further include producing a coated composition by spray coating a solution on an exemplary first composition. An exemplary solution may include at least one of alginate, pectin, agarose, carrageenan, chitosan, carboxymethyl cellulose, and polyvinyl alcohol. An exemplary method may further include mixing an exemplary coated composition with a liquid fuel.

In an exemplary embodiment, an exemplary adsorbent may include at least one of a metal-organic adsorbent, a carbon-based adsorbent, and a polymeric adsorbent.

In an exemplary embodiment, producing an exemplary first composition may include injecting an exemplary gas into a closed container containing an exemplary adsorbent to reach a pressure between 1 bar and 30 bar.

In an exemplary embodiment, producing an exemplary coated composition may further include mixing an exemplary adsorbent utilizing a mixer with a rotational speed of between 20 rpm and 100 rpm.

In an exemplary embodiment, producing an exemplary coated composition may include spray coating a sodium alginate solution on an exemplary first composition. In an exemplary embodiment, a weight ratio of an exemplary sodium alginate solution and an exemplary adsorbent may be between 100:1 and 10:1 (sodium alginate solution:adsorbent).

In an exemplary embodiment, producing an exemplary coated composition may further include spray coating a calcium chloride dehydrate solution over an exemplary first composition. In an exemplary embodiment, a weight ratio of an exemplary calcium chloride dehydrate solution and an exemplary adsorbent may be between 100:1 and 10:1 (calcium chloride dehydrate solution:adsorbent).

In an exemplary embodiment, mixing an exemplary coated composition with an exemplary liquid fuel may include adding an exemplary coated composition to an exemplary liquid fuel with a weight ratio of between $1:10^6$ and 1:10 (adsorbent:liquid fuel).

In an exemplary embodiment, mixing an exemplary coated composition with an exemplary liquid fuel may include adding a surfactant into an exemplary mixture of an exemplary coated composition and an exemplary liquid fuel. In an exemplary embodiment, a weight ratio of an exemplary surfactant and an exemplary adsorbent may be between 0.1:1 and 5:1 (surfactant:adsorbent).

According to one or more exemplary embodiments, the present disclosure is directed to coated additive. In an exemplary embodiment, an exemplary coated additive may include a coated adsorbent and a gas. In an exemplary embodiment, an exemplary coated adsorbent may include a porous adsorbent coated with a coating solution, in which an exemplary gas may be trapped in pores of an exemplary porous adsorbent.

In an exemplary embodiment, an exemplary porous adsorbent may include at least one of a metal-organic adsorbent, a carbon-based adsorbent and a polymeric adsorbent.

In an exemplary embodiment, an exemplary gas may be trapped in exemplary plurality of pores of an exemplary porous adsorbent with a weight ratio of between $1:10^6$ and 1:5 (gas:adsorbent).

In an exemplary embodiment, an exemplary coating solution may include at least one of alginate, pectin, agarose, carrageenan, chitosan, carboxymethyl cellulose, and polyvinyl alcohol.

In an exemplary embodiment, an exemplary coated additive may further include a surfactant, in which an exemplary surfactant may include at least one of oleic acid, oleylamine, polysorbate 20, sorbitan esters, octyl phenol ethoxylate, and glycerol.

BRIEF DESCRIPTION OF THE DRAWINGS

The novel features which are believed to be characteristic of the present disclosure, as to its structure, organization, use and method of operation, together with further objectives and advantages thereof, will be better understood from the following drawings in which a presently preferred embodiment of the present disclosure will now be illustrated by way of example. It is expressly understood, however, that the drawings are for illustration and description only and are not intended as a definition of the limits of the present disclosure. Embodiments of the present disclosure will now be described by way of example in association with the accompanying drawings in which.

DETAILED DESCRIPTION

Figure 1:
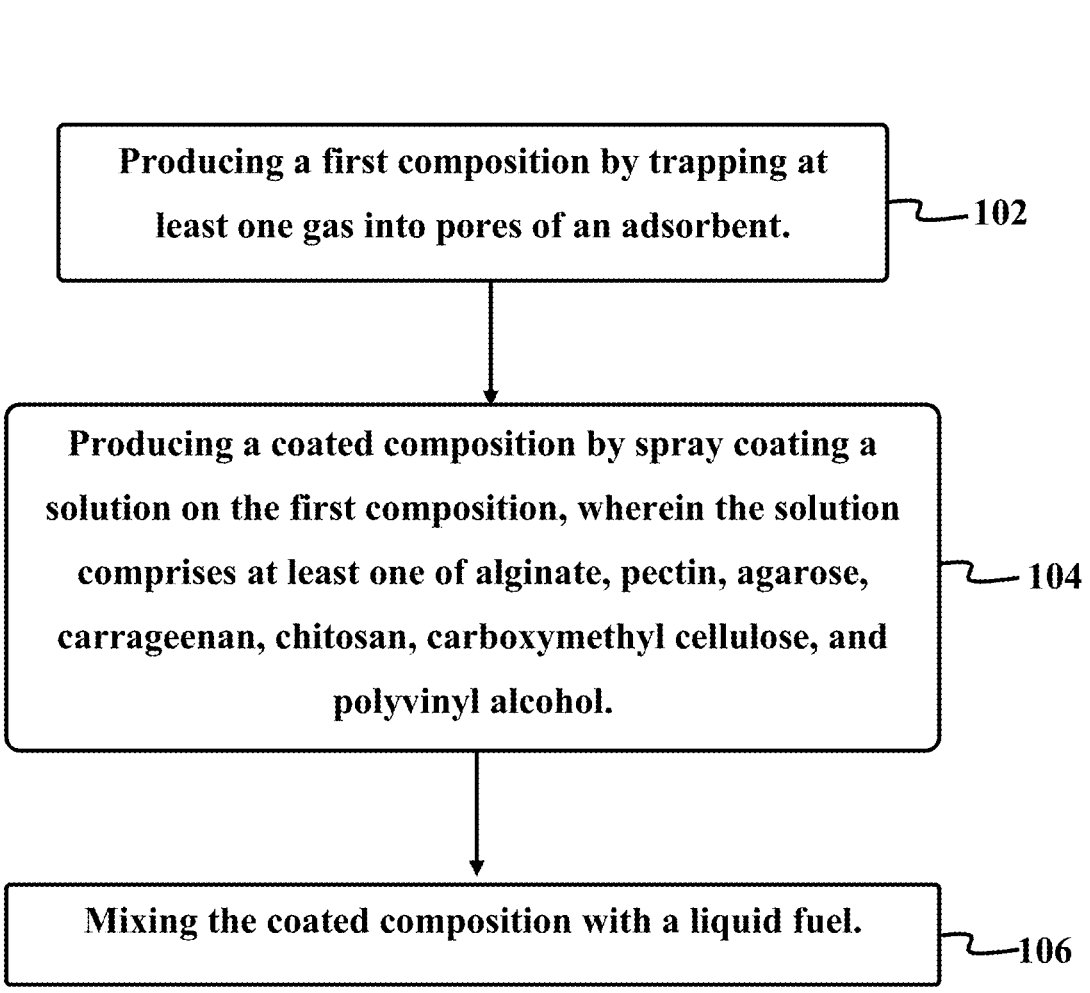
FIG. 1 illustrates a flowchart of a method for producing a three-phase fuel composition, consistent with one or more exemplary embodiments of the present disclosure.

The novel features which are believed to be characteristic of the present disclosure, as to its structure, organization, use and method of operation, together with further objectives and advantages thereof, will be better understood from the following discussion.

The present disclosure is directed to exemplary embodiments of a three-phase fuel composition with three phases of gas, liquid, and solid. An exemplary three-phase fuel composition may include a coated additive made of gases entrapped within pores of a coated adsorbent. An exemplary adsorbent may include a porous adsorbent, such as polymers, carbon-based materials, or metal-organic adsorbents. For example, an exemplary metal-organic adsorbent may have a structure including MIL-96, MIL-100, MIL-101, UIO-66, ZIF-8, ZIF-67, MOF-177, MOF-253, soc-MOF, M3(BTC)2, HKUST-1, NU-125, and MOF-74 that may enhance specific surface area of an exemplary metal-organic adsorbent. In an exemplary embodiment, an exemplary metal-organic adsorbent may further include a metal source, such as chromium, zinc, iron, and zirconium, which may form the core of an exemplary metal-organic framework.

In an exemplary embodiment, exemplary gases that may be entrapped within pores of exemplary adsorbents may include at least one of oxygen, methane, hydrogen, a biogas, and air, which may allow for an enhanced combustion of an exemplary liquid fuel. Such entrapped or stored gases may be stored within pores of an exemplary adsorbent with a concentration between 1 ppm and 200000 ppm, in which exemplary pores of an exemplary adsorbent may be in a scale of 6 Å to 36 Å.

In an exemplary embodiment, to form an exemplary coated additive, a coating solution may be coated on an exemplary adsorbent, in which an exemplary coating may cover exemplary pores of an exemplary adsorbent. An exemplary coating solution and an exemplary adsorbent may have a weight ratio between 100:1 and 10:1 (coating solution:adsorbent). In an exemplary embodiment, such coating of an adsorbent by a coating solution may allow for a safer storage of exemplary gases inside exemplary pores of an exemplary adsorbent. In an exemplary embodiment, an exemplary coating solution may include at least one of polymeric materials, polysaccharides, cellulose materials, alginate, pectin, chitin, agarose, carrageenan, methyl cellulose, ethyl cellulose, chitosan, chondroitin, carboxymethyl cellulose, dextran, and polyvinyl alcohol.

In an exemplary embodiment, an exemplary three-phase fuel composition may further include an exemplary liquid fuel, in which the weight ratio of an exemplary adsorbent and an exemplary liquid fuel may be between $1:10^6$ and 1:10 (adsorbent:liquid fuel). In an exemplary embodiment, an exemplary coated additive may be added into an exemplary liquid fuel, in which an exemplary liquid fuel may include at least one of diesel, gasoline, kerosene, mazut, biodiesel, bioethanol, biomethanol, ethanol, methanol, liquid hydrogen, and synthetic liquid fuels, such as products obtained from coal, natural gas, and biomaterials.

In an exemplary embodiment, an exemplary coated additive may further include a surfactant. An exemplary surfactant may stabilize an exemplary coated additive inside an exemplary liquid fuel. An exemplary surfactant may include at least one of oleic acid, oleylamine, polysorbate 20, sorbitan esters, octyl phenol ethoxylate, and glycerol, which may be added into an exemplary liquid fuel with a weight ratio of between 0.1:1 and 5:1 (surfactant:adsorbent).

FIG. 1 illustrates a flowchart of method 100 for producing a three-phase fuel composition, consistent with one or more exemplary embodiments of the present disclosure. In an exemplary embodiment, method 100 may include a step 102 of producing a first composition by trapping at least one gas into pores of an adsorbent, a step 104 of producing a coated composition by spray coating a solution on the first composition, in which the solution comprises at least one of alginate, pectin, agarose, carrageenan, chitosan, carboxymethyl cellulose, and polyvinyl alcohol, and a step 106 of mixing the coated composition with a liquid fuel.

In an exemplary embodiment, step 102 of producing the first composition may include synthesizing an adsorbent, in which an exemplary adsorbent may be synthesized by, for example, a hydrothermal or a solvothermal method. As used herein, a hydrothermal method may refer to a process of heating a metal source, a linker, a modulator, and water to produce an exemplary adsorbent. In an exemplary embodiment, before an exemplary heating process, exemplary ingredients of an exemplary adsorbent may be mixed utilizing, for example a magnetic stirrer at between 500 rpm and 1000 rpm for 5 minutes to 15 minutes. As used herein, an exemplary magnetic stirrer may refer to a device that may employ a rotating magnetic field to stimulate a stir bar immersed in a liquid to rotate. In an exemplary embodiment, an exemplary metal source, an exemplary linker, an exemplary modulator, and water may be heated at a temperature between 180° C. and 220° C. for between 6 hours and 9 hours. In an exemplary embodiment, an exemplary heating process may be performed in, for example, an autoclave. In an exemplary embodiment, an exemplary adsorbent may be washed with water, an ethanol solution, and dimethylformamide (DMF), consecutively to eliminate the unreacted metal source. In an exemplary embodiment, an exemplary adsorbent may be mixed with water with a weight ratio of between 1:10 and 1:20 (adsorbent:water). An exemplary mixing process may be performed utilizing, for example an exemplary magnetic stirrer with a rotational speed of between 500 rpm and 1000 rpm for between 5 minutes and 15 minutes. To separate an exemplary adsorbent, an exemplary mixture of an exemplary adsorbent and water may be filtered utilizing, for example a filter paper.

In an exemplary embodiment, an exemplary adsorbent may be mixed with an exemplary ethanol solution at a temperature of between 70° C. and 90° C. and with a weight ratio of between 1:1 and 1:10 (adsorbent:ethanol solution). In an exemplary embodiment, an exemplary adsorbent may be mixed with an exemplary ethanol solution utilizing, for example an exemplary magnetic stirrer at a rotational speed of between 500 rpm and 1000 rpm for between 4 hours and 8 hours. In an exemplary embodiment, an exemplary ethanol solution may have a concentration of between 96% (v/v) and 100% (v/v). In an exemplary embodiment, an exemplary mixture of an exemplary adsorbent and an exemplary ethanol solution may be centrifuged at a rotational speed of between 8000 rpm and 10000 rpm for between 10 minutes and 15 minutes.

In an exemplary embodiment, an exemplary process of washing an exemplary adsorbent by an exemplary ethanol solution may be repeated three times. In an exemplary embodiment, an exemplary adsorbent may be mixed with DMF utilizing, for example, an exemplary magnetic stirrer at a rotational speed of between 500 rpm and 1000 rpm for 4 hours and 8 hours at a temperature of between 70° C. and 90° C. In an exemplary embodiment, an exemplary mixture of an exemplary adsorbent and DMF may be centrifuged at a rotational speed of between 8000 rpm and 10000 rpm for between 10 minutes and 15 minutes. In an exemplary embodiment, an exemplary process of washing an exemplary adsorbent with DMF may be repeated three times. In an exemplary embodiment, an exemplary adsorbent may be mixed with DMF with a weight ratio of between 1:1 and 1:10 (adsorbent:DMF).

After an exemplary washing process, an exemplary adsorbent may be purified by an ammonium fluoride solution and an ethanol solution, consecutively. In an exemplary embodiment, an exemplary adsorbent may be mixed with an exemplary ammonium fluoride solution utilizing, for example, an exemplary magnetic stirrer at a rotational speed of between 500 rpm and 1000 rpm for between 4 hours and 8 hours. In an exemplary embodiment, an exemplary mixture of an exemplary adsorbent and an exemplary ammonium fluoride solution may be centrifuged at a rotational speed of between 8000 rpm and 10000 rpm for 10 minutes to 15 minutes. In an exemplary embodiment, an exemplary ammonium fluoride solution may have a concentration between 0.5% (W/V) and 1% (W/V) of an ammonium fluoride salt in water. In an exemplary embodiment, an exemplary adsorbent may be mixed with an exemplary ammonium fluoride solution with a weight ratio of between 1:1 and 1:10 (ammonium fluoride solution:adsorbent).

After an exemplary purification process by an exemplary ammonium fluoride solution, an exemplary adsorbent may be mixed with an ethanol solution at a rotational speed of between 500 and 1000 for 2 hours to 4 hours. In an exemplary embodiment, an exemplary mixture of an exemplary adsorbent and an exemplary ethanol solution may be centrifuged at a rotational speed of between 8000 rpm and 10000 rpm for 10 minutes to 15 minutes at a temperature of between 70° C. and 90° C. In an exemplary embodiment, an exemplary ethanol solution for an exemplary purification process may be a pure ethanol solution with negligible trace of water. In an exemplary embodiment, an exemplary process of purification may be performed to eliminate an unreacted linker. In an exemplary embodiment, an exemplary adsorbent may be dried at room temperature for between 12 hours and 24 hours. In an exemplary embodiment, an exemplary adsorbent may include at least one of a metal-organic adsorbent, a carbon-based adsorbent, and a polymeric adsorbent. In an exemplary embodiment, an exemplary adsorbent may be a metal-organic adsorbent, in which an exemplary metal source may include chromium, zinc, iron, and zirconium.

In an exemplary embodiment, an exemplary linker may include terephthalic acid, tricarboxylic acid, and dicarboxylic acid, which may form the organic section of an exemplary metal-organic adsorbent. In an exemplary embodiment, an exemplary modulator may include nitric acid, which may control the crystallization process and may also inhibit agglomeration of an exemplary metal-organic adsorbent.

In an exemplary embodiment, an exemplary step 102 of producing the first composition may further include trapping at least one gas into pores of the adsorbent. In an exemplary embodiment, to produce an exemplary first composition, an exemplary process of trapping gases into exemplary pores of exemplary adsorbents may be performed in a reactor. In an exemplary embodiment, an exemplary reactor may include a container, a mixer, a heater, a spray nozzle, and a vacuum pump. In an exemplary embodiment, an exemplary mixer may be located inside an exemplary container and may include rotating wings. In an exemplary embodiment, an exemplary vacuum pump may be connected to an exemplary container utilizing a connector. In an exemplary embodiment, an exemplary spray nozzle may be located on an exemplary container. In an exemplary embodiment, the air inside an exemplary container may be vacuumed utilizing an exemplary vacuum pump in which an exemplary container may have a pressure between 0.5 bar and 0.99 bar. In an exemplary embodiment, an exemplary container may be heated at a temperature between 50° C. and 100° C. utilizing an exemplary heater during an exemplary vacuum process. In an exemplary embodiment, at least one gas may be injected into the reactor with a pressure of between 1 bar and 30 bar at room temperature. In an exemplary embodiment, an exemplary gas may be injected into the reactor, while an exemplary adsorbent is being mixed in the reactor at a stirrer speed between 20 rpm and 100 rpm for 1 to 10 minutes. In an exemplary embodiment, an exemplary gas may include at least one of oxygen, methane, hydrogen, and a biogas. In an exemplary embodiment, such exposure of an exemplary gas and an exemplary adsorbent may lead to gas molecules being trapped within the pores of an exemplary adsorbent.

In an exemplary embodiment, an exemplary step 104 of producing the coated composition may include spray coating the solution on the first composition, utilizing an exemplary spray nozzle. In an exemplary embodiment, such coating of the first composition may prevent entrapped gas molecules to penetrate out of exemplary pores of the first composition. In an exemplary embodiment, an exemplary solution may include alginate, pectin, agarose, carrageenan, chitosan, carboxymethyl cellulose, and polyvinyl alcohol with a weight ratio of an exemplary solution and an exemplary adsorbent between 10:1 and 100:1 (solution:adsorbent).

For example, a sodium alginate solution may be spray coated on an exemplary first composition for between 1 minute and 10 minutes. In an exemplary embodiment, after an exemplary spray coating process of an exemplary sodium alginate solution, a calcium chloride dehydrate ($CaCl_2.2H_2O$) solution may further be spray coated on an exemplary first composition utilizing an exemplary spray nozzle for between 1 minute and 10 minutes. In an exemplary embodiment, the calcium chloride dehydrate solution may form ionic bonds with the sodium alginate to develop a cross-linked polymer framework. In an exemplary embodiment, an exemplary coated composition may be dried at a temperature between 30° C. and 70° C. for 1 to 10 hours.

In an exemplary embodiment, an exemplary step 106 of mixing the coated composition with the liquid fuel may include mixing an exemplary coated composition with the liquid fuel utilizing a mechanical mixer or an ultrasonic device. As used herein, an exemplary mechanical mixer may include wings which may uniformly mix materials by shearing power of rotating wings and an exemplary ultrasonic device may uniformly mix materials by an ultrasonic power which may include an ultrasonic bath and an ultrasonic probe device. In an exemplary embodiment, a surfactant may be used to stabilize an exemplary coated composition inside an exemplary liquid fuel. In an exemplary embodiment, an exemplary mixture of an exemplary coated composition and an exemplary surfactant may be mixed in, for example an ultrasonic bath with an ultrasonic power of between 100 W and 500 W for between 1 to 20 minutes. In an exemplary embodiment, an exemplary coated composition may be added to an exemplary liquid fuel with a weight ratio of between $1:10^6$ and 1:10 (adsorbent:liquid fuel), in which an exemplary liquid fuel may include at least one of diesel, gasoline, kerosene, mazut, biodiesel, bioethanol, ethanol, methanol, liquid hydrogen, and synthetic liquid fuels, such as products obtained from coal, natural gas, and biomaterials.

In an exemplary embodiment, an exemplary surfactant may be added to an exemplary coated composition with a weight ratio of an exemplary surfactant and an exemplary coated composition between 0.1:1 and 5:1 (surfactant:adsorbent) in which an exemplary surfactant may include at least one of oleic acid, oleylamine, polysorbate 20, sorbitan esters, octyl phenol ethoxylate, and glycerol.

Example 1: Producing a Metal-Organic Adsorbent

In this example, an MIL-01 (Cr) adsorbent was synthesized by a method similar to method 100. To this end, 1 mmol chrome nitrate, 1 mmol terephthalic acid, and 1 mmol nitric acid may be added to 256 mmol deionized water. The mixture may be mixed for 10 minutes at 500 rpm. The mixture may be transferred to a teflon autoclave and may be heated at 220° C. for 8 hours. The adsorbent may be set aside to cool down to the room temperature. The mixture may be washed with water with a weight ratio of between 1:10 (adsorbent:water) to eliminate the chromium nitrate salt. After washing with water, the mixture may be filtered by for example, a filter paper. The product may be mixed with an ethanol solution for 6 hours at 500 rpm at 80° C. and then may be centrifuged at 9000 rpm for 10 minutes to eliminate unreacted terephthalic acid. This process may be repeated three times. The mixture may be mixed with DMF for 6 hours at 500 rpm at 80° C. The mixture may be centrifuged at 9000 rpm for 10 minutes. This process may be repeated three times. The mixture may be dried for 12 hours at room temperature.

After the washing process, the mixture may be purified by mixing the adsorbent with a pure ethanol solution at 80° C. for 2 hours at 500 rpm. After purification with ethanol, the adsorbent may be mixed with an ammonium fluoride solution with a concentration of 0.5 wt. % of ammonium fluoride salt in water for 6 hours.

Figure 2:
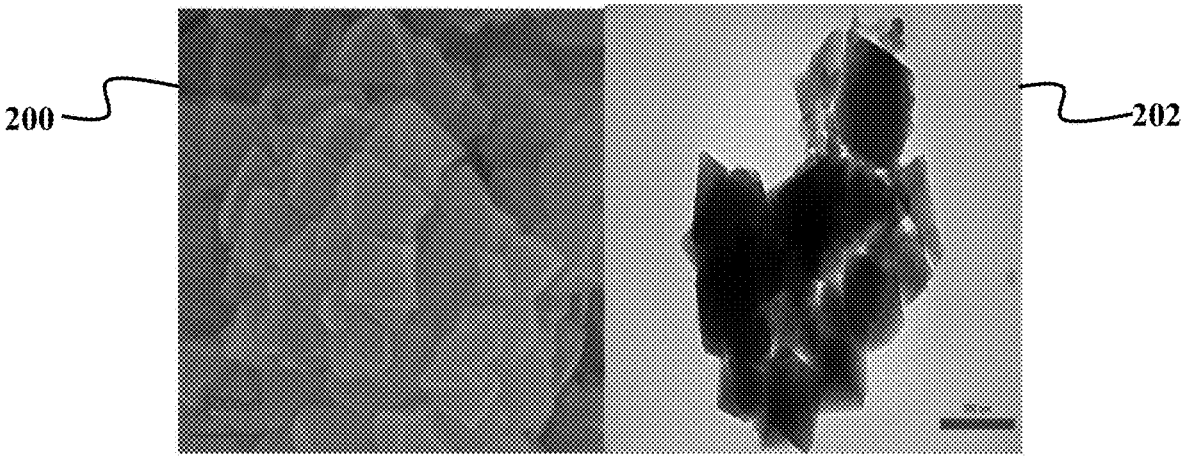
FIG. 2 illustrates a field emission electron microscopy (FE-SEM) and a transmission electron microscopy (TEM) images of an MIL-101 (Cr) adsorbent, consistent with one or more exemplary embodiments of the present disclosure.

FIG. 2 illustrates a field emission electron microscopy (FE-SEM) image 200 of an MIL-101 (Cr) adsorbent and a transmission electron microscopy (TEM) image 202 of an MIL-101 (Cr) adsorbent, consistent with one or more exemplary embodiments of the present disclosure. As evident in FESEM image 200 and TEM image 202, an octagonal crystal structure is observed with a uniform distribution of the MIL-101 (Cr) adsorbent. In addition, there may be no needle-shaped crystals in the MIL-101 (Cr) adsorbent, which may indicate effective elimination of terephthalic acid during purification process.

Figure 3:
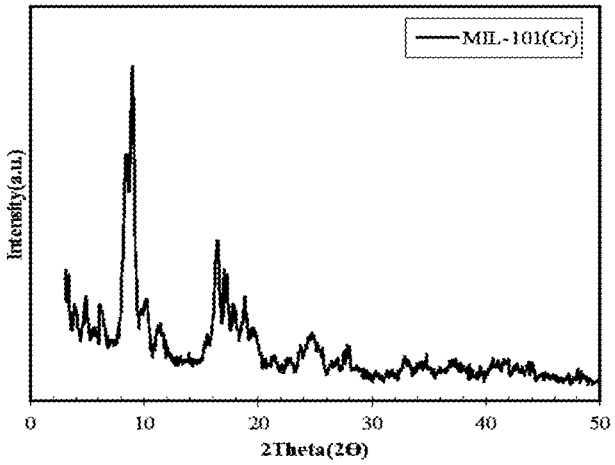
FIG. 3 illustrates an X-ray diffraction (XRD) pattern of an MIL-101 (Cr) adsorbent, consistent with one or more exemplary embodiments of the present disclosure.

FIG. 3 illustrates an XRD pattern 300 of the MIL-101 (Cr) adsorbent, consistent with one or more exemplary embodiments of the present disclosure. XRD pattern 300 may indicate the cubic structure of the MIL-101 (Cr) adsorbent. The MIL-101 (Cr) adsorbent may have characteristic peaks at 3.31°, 3.97°, 5.18°, 5.91°, 9.07°, 10.34°, 16.92°, 17.28°, and 19.55°.

Figure 4:
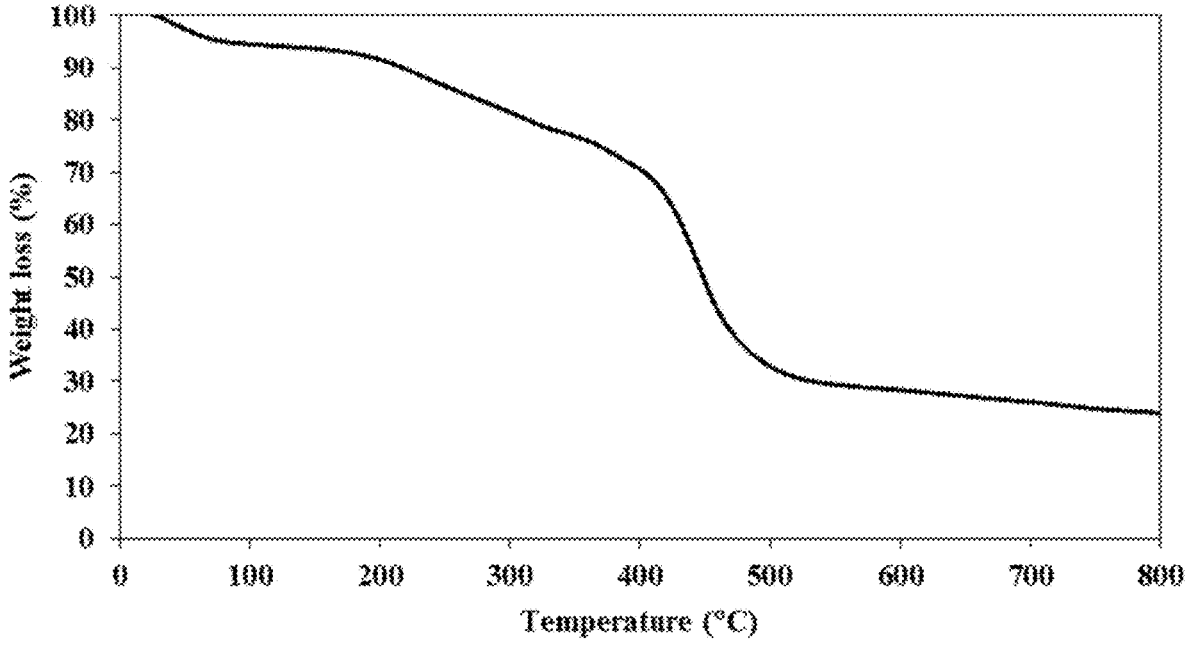
FIG. 4 illustrates a thermogravimetric analysis (TGA) curve of an MIL-101 (Cr) adsorbent, consistent with one or more exemplary embodiments of the present disclosure.

FIG. 4 illustrates a TGA curve 400 of the MIL-101 (Cr) adsorbent, consistent with one or more exemplary embodiments of the present disclosure. TGA image 400 shows an initial weight loss that may be due to the presence of moisture in the pores of the MIL-101 (Cr) adsorbent. The organic structure may be destroyed at between 300° C. and 500° C. TGA image 400 shows water molecule elimination at a temperature between 25° C. and 120° C. The failure of terephthalic acid bonds may happen at a temperature between 120° C. and 230° C. 29.1% of the structure of the MIL-101 (Cr) adsorbent may remain at 390° C.

Figure 5:
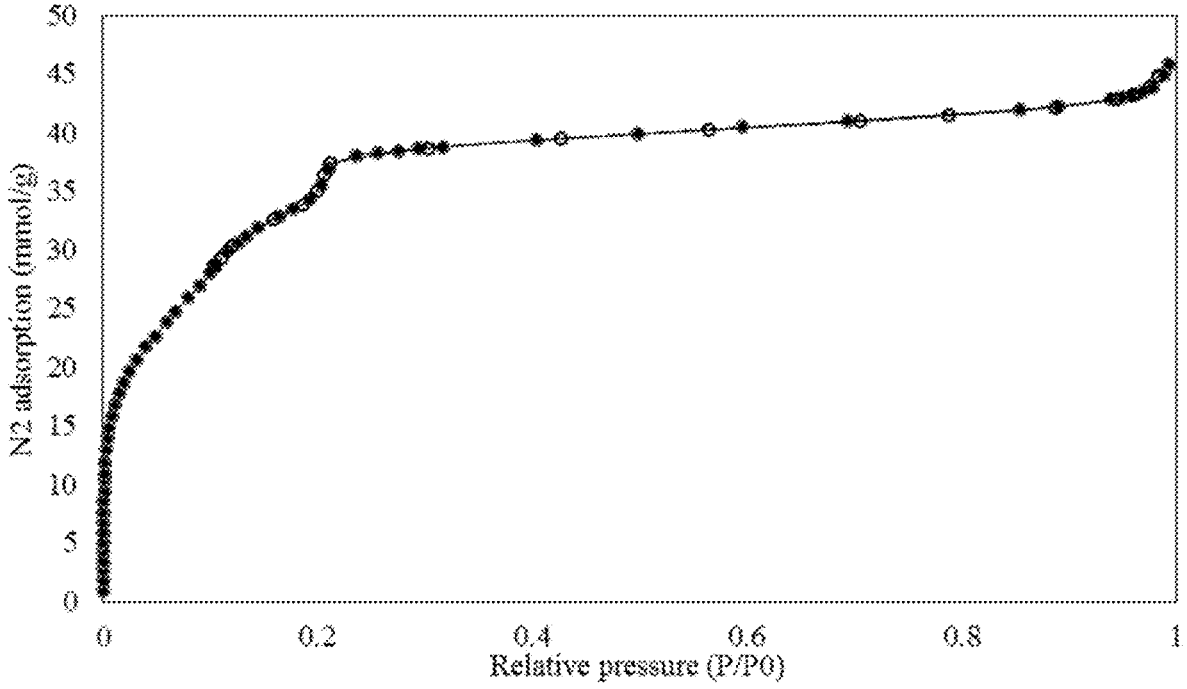
FIG. 5 illustrates a nitrogen-adsorption isotherm at 77 K for an MIL-101 (Cr) adsorbent, consistent with one or more exemplary embodiments of the present disclosure.

FIG. 5 illustrates a nitrogen-adsorption isotherm 500 at 77 K for MIL-101 (Cr) adsorbent, consistent with one or more exemplary embodiments of the present disclosure. Isotherm 500 is classified as type I according to IUPAC classification. Isotherm 500 may show two slopes at $$\frac{P}{P_0} = 0.1 \text{ and } \frac{P}{P_0} = 0.2,$$

which may be due to the presence of two types of micro-pore windows in the MIL-101 (Cr) adsorbent.

Table 1. Shows parameters of brunauer-emmett-teller (BET) and barrett-joyner-halenda (BJH) analysis related to the MIL-101 (Cr) adsorbent, consistent with one or more exemplary embodiments of the present disclosure. High surface area of the produced MIL-101 (Cr) in comparison with carbon-based adsorbents may be a superiority for the MIL-101 (Cr) adsorbent.

TABLE 1

| Samples | Surface area ($m^2/g$) | Total pore volume ($cm^3/g$) | Average pore diameter (nm) |
|---|---|---|---|
| MIL-101(Cr) | 3129 | 1.41 | 0.98 |

Figure 6:
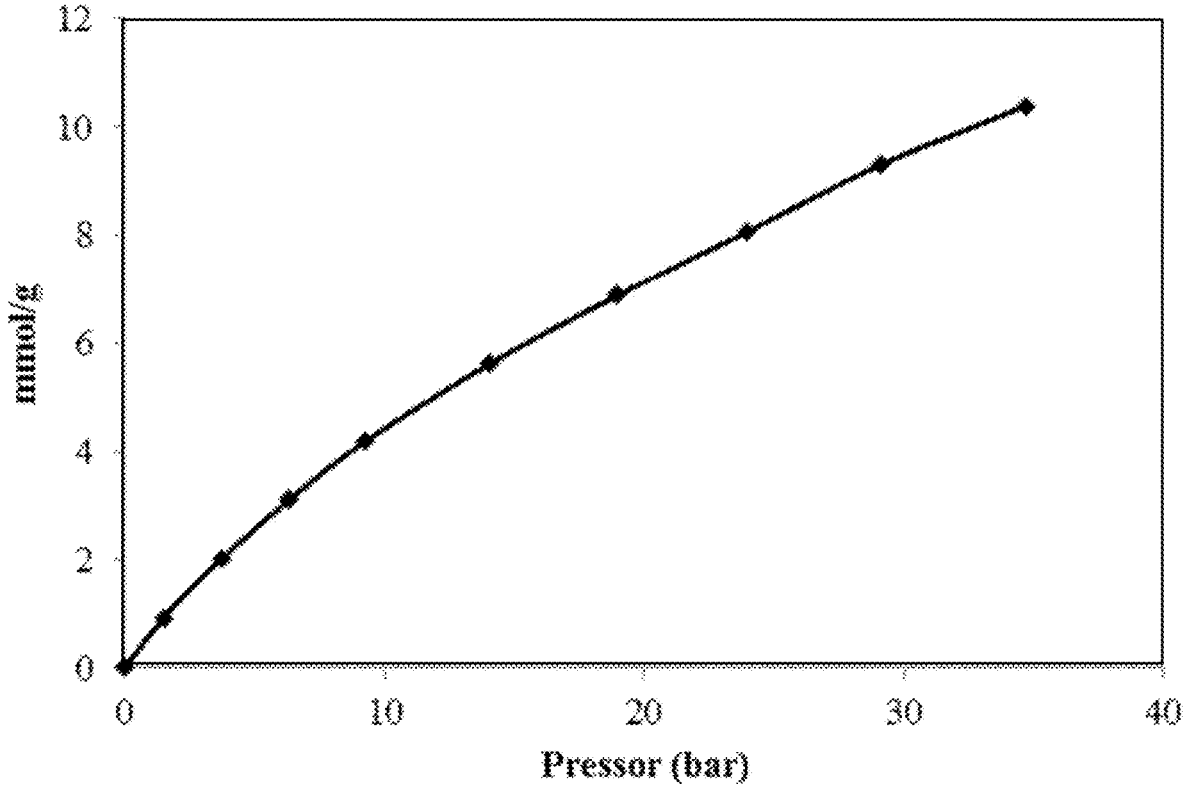
FIG. 6 illustrates a methane-adsorption isotherm for an MIL-101 (Cr) adsorbent, consistent with one or more exemplary embodiments of the present disclosure.

FIG. 6 illustrates an adsorption isotherm 600 for methane for the MIL-101 (Cr) adsorbent under a pressure between 1 bar and 33 bar, consistent with one or more exemplary embodiments of the present disclosure. Adsorption isotherm 600 shows 10.3 mmol/g of methane adsorption under a pressure of 33 bar.

Figure 7:
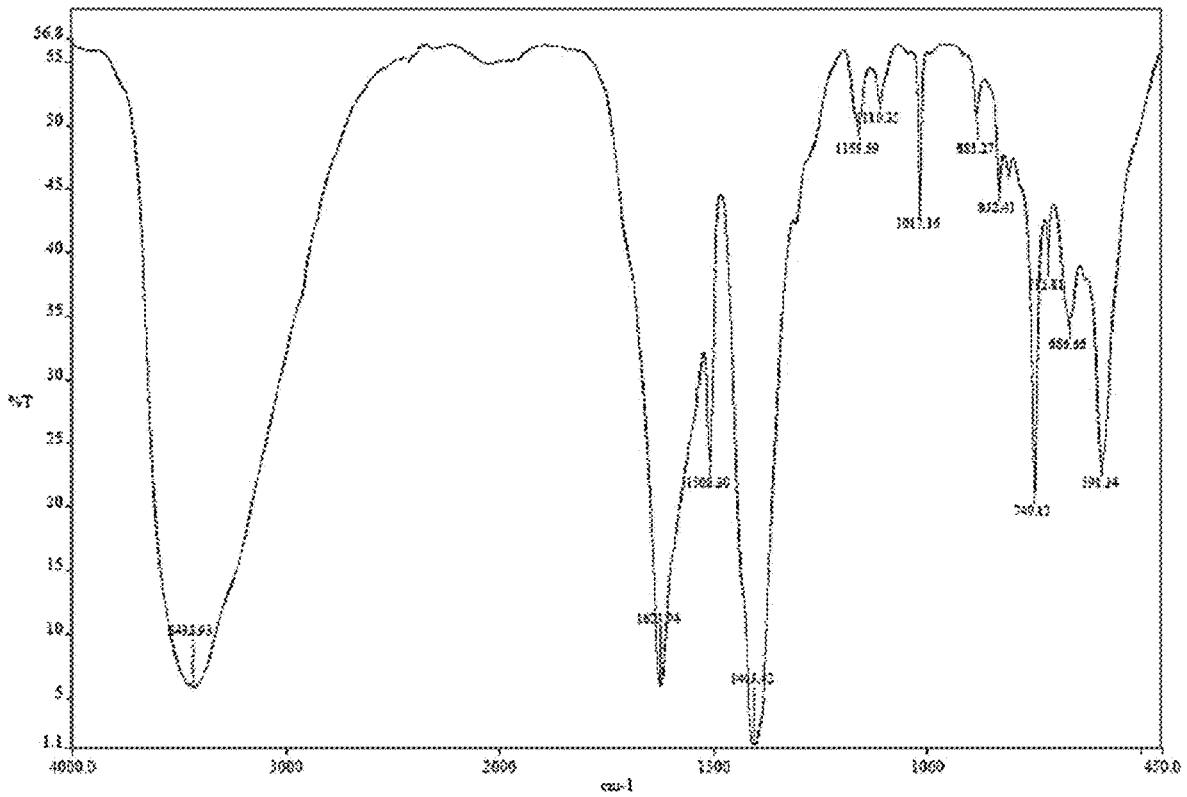
FIG. 7 illustrates a Fourier transform infrared spectroscopy (FT-IR) image of an MIL-101 (Cr) adsorbent, consistent with one or more exemplary embodiments of the present disclosure.

FIG. 7 illustrates an FT-IR image 700 of MIL-101 (Cr) adsorbent, consistent with one or more exemplary embodiments of the present disclosure. FT-IR image 700 shows OH bond at 2500-3300 cm' for terephthalic acid. The peak at 2500-3300 cm' is sharper for the MIL-101 (Cr) adsorbent in comparison with pure terephthalic acid which may indicate that the H atom in terephthalic acid is replaced with a metal.

Example 2: Storing Gases in a Metal-Organic Adsorbent

In this example, storing gases in an MIL-01 (Cr) adsorbent was performed by a method similar to method 100. To this end, 1 g of the MIL-101 (Cr) adsorbent may be added into a reactor. A pressurized reactor may be used to store gasses inside the pores of the adsorbent. The air inside the reactor may be vacuumed before injecting the gas and the reactor may be heated at a temperature of between 50° C. and 100° C. Then the reactor may be cooled to the ambient temperature. Oxygen may be purged into the reactor under a pressure of between 1 bar and 30 bar. The MIL-101 (Cr) adsorbent may be under pressure for between 1 minute and 5 minutes. Then sodium alginate may be spray coated on the sample to fully cover the adsorbent. The sample may be exposed to sodium alginate solution for between 1 minute and 10 minutes. For the next step, a calcium chloride dehydrate solution with the concentration of between 1 wt. % and 10 wt. % may be spray coated on the sample. The sample may be exposed to the calcium chloride dehydrate solution for between 1 minute and 10 minutes. The sample may be removed from the reactor and dried at a temperature of between 30° C. and 70° C.

Example 3: Stabilizing the Adsorbent Inside the Liquid Fuel

In this example, stabilizing the MIL-01 (Cr) adsorbent inside the liquid fuel was performed by a method similar to method 100. To produce a three-phase fuel composition, 100 ppm of the sample prepared according to method 100 may be added to a diesel fuel. Oleic acid may be added to the liquid fuel as a surfactant with a weight ratio of 2:1 (surfactant:adsorbent). The mixture may be placed in an ultrasonic bath for 5 minutes.

Figure 8:
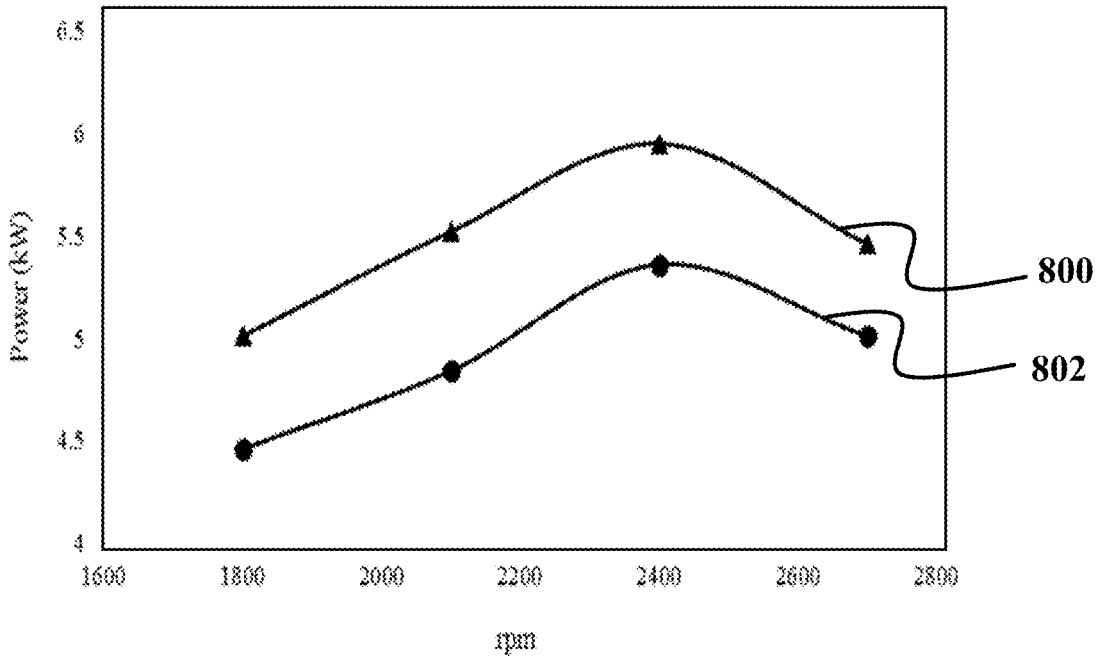
FIG. 8 illustrates engine power versus engine speed curves, consistent with one or more exemplary embodiments of the present disclosure.
Figure 9:
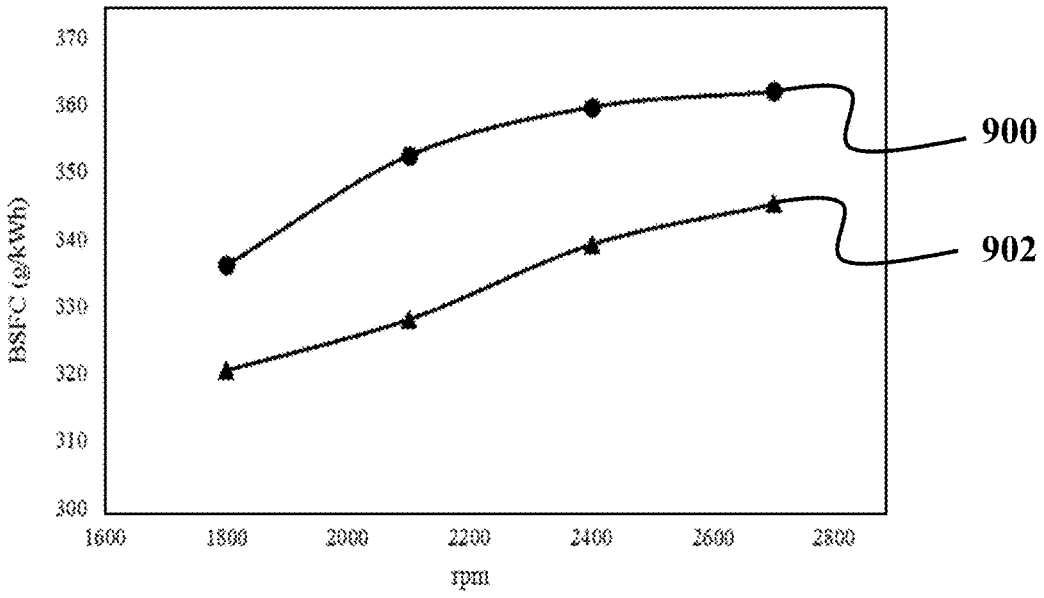
FIG. 9 illustrates break specific fuel consumption (BSFC) curves for a pure diesel fuel and a three-phase fuel composition, consistent with one or more exemplary embodiments of the present disclosure.

Example 4: Evaluation of a Three-Phase Fuel Composition Containing Oxygen Gas To evaluate the effectiveness of the produced three-phase fuel composition, a single-cylinder-diesel engine connected to an eddy-current dynamometer may be used. To have a comparison, a diesel fuel and a diesel fuel containing three-phase fuel composition may be tested at room temperature with three repetitions. The engine performance parameters may be measured, such as power, specific fuel consumption, engine exhaust pollutants including $CO_2$, $NO_x$ and HC. The results may show that using three-phase fuel composition may reduce break specific fuel consumption (BSFC) which may be due to the complete combustion. On the other hand, the presence of the MIL-101 (Cr) adsorbent particles may enhance mixing of the fuel and air by increasing the contact surface between air and the fuel. The presence of oxygen inside the MIL-101 (Cr) adsorbent may also lead to a complete combustion. FIG. 8 illustrates a variations of the engine power versus engine speed curve 800 for three-phase fuel composition and a variations of the engine power versus engine speed curve 802 for pure diesel fuel, consistent with one or exemplary embodiments of the present disclosure. As shown in FIG. 8, the engine power may increase by 9 to 14 percent when three-phase fuel composition is used. Results may also indicate the decrease of BSFC when three-phase fuel composition is used. FIG. 9 illustrates a BSFC curve 900 for pure diesel and a BSFC curve 902 for three-phase fuel composition, consistent with one or exemplary embodiments of the present disclosure. FIG. 9 shows the reduction of about 4 to 7 percent for the three-phase fuel in comparison to the pure diesel fuel.

Figure 10:
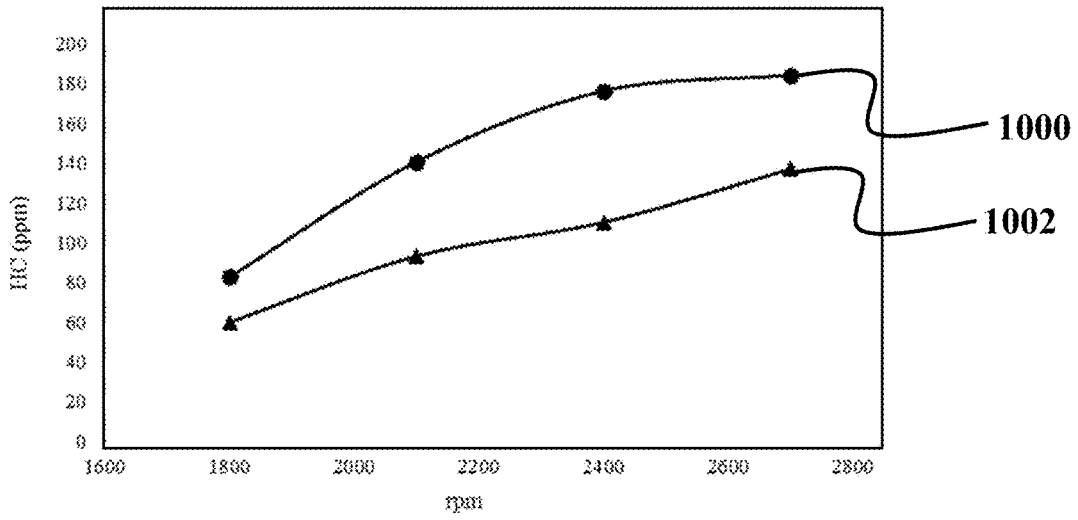
FIG. 10 illustrates hydrocarbon-production curves (HC) in an engine burning a pure diesel fuel and in an engine burning a three-phase fuel composition, consistent with one or more exemplary embodiments of the present disclosure.

Exhaust emissions of diesel engines may also be examined. Results may show reduction in the pollutants. FIG. 10 illustrates an HC-production curve 1000 for pure diesel and an HC-production curve 1002 for the three-phase fuel composition, consistent with one or exemplary embodiments of the present disclosure. HC pollutants may be due to the incomplete combustion process which may decrease when the three-phase fuel composition is used.

Figure 11:
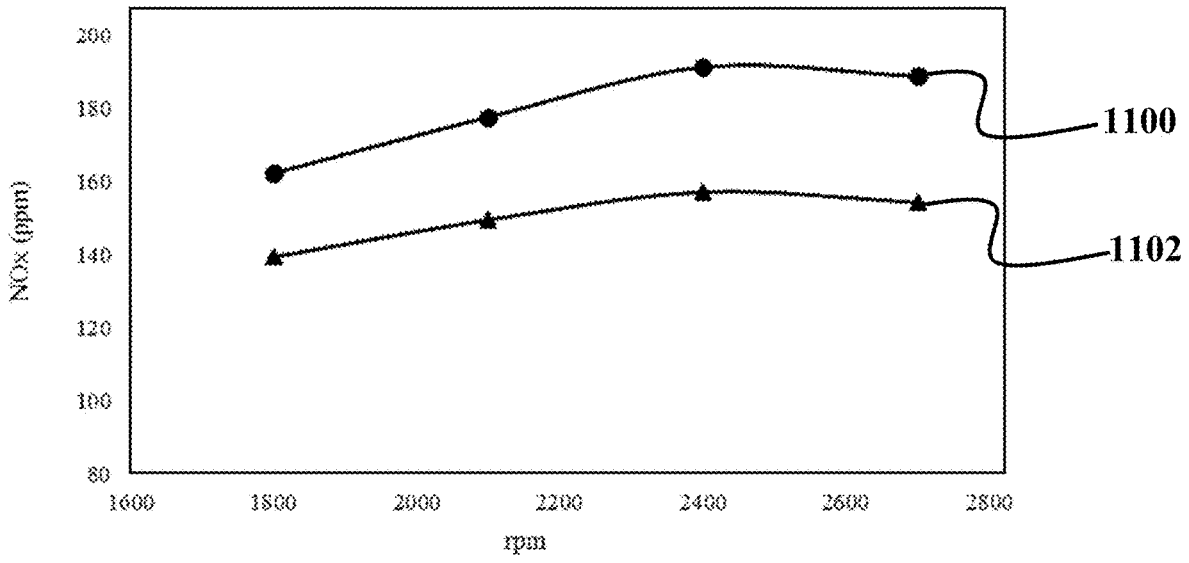
FIG. 11 illustrates $NO_x$ production curves of an engine burning a pure diesel fuel and an engine burning a three-phase fuel composition, consistent with one or more exemplary embodiments of the present disclosure.
Figure 12:
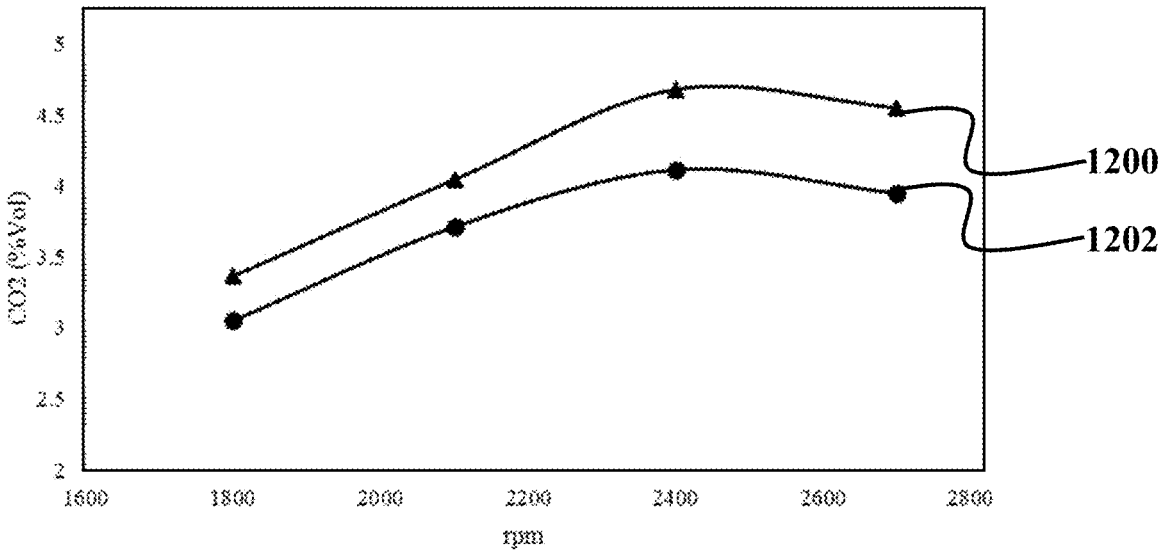
FIG. 12 illustrates $CO_2$ production curves of an engine burning a three-phase fuel composition and an engine burning a pure diesel fuel, consistent with one or more exemplary embodiments of the present disclosure.

Results may indicate that supplying sufficient oxygen in the combustion process when using three-phase fuel may enhance mixing of the fuel and air. HCs reduction of between 25% and 37% may be the response of the enhancement in the mixture of the fuel and air. The main reason of producing nitrogen oxides may be the high temperature in the combustion chamber. O atoms which may be the product of $O_2$ decomposition at high temperature, may bind with nitrogen atoms in air and produce NO. Therefore, using three-phase fuel composition may lessen the emission of pollutants and increase $CO_2$ production which may be a product of complete combustion. FIG. 11 illustrates a $NO_x$ production curve 1100 for pure diesel and a $NO_x$ production curve 1102 for three-phase fuel composition, consistent with one or exemplary embodiments of the present disclosure. FIG. 12 illustrates a $CO_2$ production curve 1200 for the three-phase fuel composition and a $CO_2$ production curve 1202 for pure diesel, consistent with one or exemplary embodiments of the present disclosure. Using the three-phase fuel composition may decrease $NO_x$ production between 14% and 18%. FIG. 12 may show the increase of $CO_2$ production between 9% and 15% while using the three-phase fuel composition.

Example 5: Storing Methane in the MIL-101 (Cr) Adsorbent

In this example, storing methane in the MIL-01 (Cr) adsorbent was performed by a method similar to method 100. To this end, 1 gram of the MIL-101 (Cr) adsorbent which may be produced according to method 100, may be poured into a reactor and the reactor may be completely sealed. The temperature may be increased up to between 50° C. and 100° C. and the air may be vacuumed utilizing a vacuum pump. Methane may be injected to the reactor under a pressure of between 1 bar and 30 bar for between 1 minute and 5 minutes. The sodium alginate solution of example 1 may be spray coated on the adsorbent for between 1 minute and 10 minutes.

Example 6: Stabilization of Methane Inside the MIL-101 (Cr) Adsorbent

In this example, stabilizing methane inside the MIL-01 (Cr) adsorbent was performed by a method similar to method 100. To this end, 200 ppm of MIL-101 (Cr) adsorbent may be added to a diesel fuel and oleylamine may be added as the surfactant. Oleylamine may be added with a ratio of 1:1 of between surfactant and adsorbent to the mixture of fuels. The mixture of fuels and the surfactant may be mixed for 5 minutes.

Example 7: Evaluation of the Three-Phase Fuel Composition Containing Methane

To evaluate the effectiveness of the produced three-phase fuel composition, a single-cylinder-diesel engine connected to an eddy-current dynamometer may be used. To have a comparison, a diesel fuel and a diesel fuel containing three-phase fuel composition may be tested at room temperature with three repetitions. Results may indicate the increase of the engine power and the reduction of BSFC when using the three-phase fuel composition. Results may show the increase of between 7% and 11% of engine power and the reduction of between 4% and 7% in BSFCs. According to the results, a combination of gases may be used for producing the three-phase fuel composition.

The embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for description and not of limitation, such that the terminology or phraseology of the present specification is to be interpreted by the skilled artisan in light of the teachings and guidance.

The breadth and scope of the present disclosure should not be limited by any of the above-described exemplary embodiments but should be defined only in accordance with the following claims and their equivalents.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps. Moreover, the word "substantially" when used with an adjective or adverb is intended to enhance the scope of the particular characteristic; e.g., substantially planar is intended to mean planar, nearly planar and/or exhibiting characteristics associated with a planar element. Further use of relative terms such as "vertical", "horizontal", "up", "down", and "side-to-side" are used in a relative sense to the normal orientation of the apparatus.

What is claimed is:

1. A method for producing a three-phase fuel composition, the method-comprising:

producing a first composition by trapping at least one gas into pores of an adsorbent;

producing a coated composition by spray coating a solution on the first composition, wherein the solution comprises at least one of alginate, pectin, agarose, carrageenan, chitosan, carboxymethyl cellulose, and polyvinyl alcohol; and mixing the coated composition with a liquid fuel.

2. The method of claim 1, wherein the adsorbent comprises at least one of a metal-organic adsorbent, a carbon-based adsorbent, and a polymeric adsorbent.

3. The method of claim 2, wherein producing the first composition comprises injecting the gas into a closed container containing the adsorbent to reach a pressure between 1 bar and 30 bar.

4. The method of claim 3, wherein producing the coated composition further comprises mixing the adsorbent utilizing a mixer with a rotational speed of between 20 rpm and 100 rpm.

5. The method of claim 1, wherein producing the coated composition comprises spray coating a sodium alginate solution on the first composition, wherein a weight ratio of the sodium alginate solution and the absorbent is between 100:1 and 10:1 (sodium alginate solution:adsorbent).

6. The method of claim 5, wherein producing the coated composition further comprises spray coating a calcium chloride dehydrate solution over the first composition, wherein a weight ratio of the calcium chloride dehydrate solution and the adsorbent is between 100:1 and 10:1 (calcium chloride dehydrate solution:adsorbent).

7. The method of claim 6, wherein producing the coated composition comprises heating the coated composition at a temperature of between 30° C. and 70° C.

8. The method of claim 1, wherein mixing the coated composition with the liquid fuel comprises adding the coated composition to the liquid fuel, wherein a weight ratio of the adsorbent and the liquid fuel is between $1:10^6$ and 1:10 (adsorbent:liquid fuel).

9. The method of claim 1, wherein mixing the coated composition with the liquid fuel comprises adding a surfactant into the mixture of the coated composition and the liquid fuel, wherein a weight ratio of the surfactant and the adsorbent is between 0.1:1 and 5:1 (surfactant:adsorbent).

10. A coated additive, comprising:

a gas comprising at least one of oxygen, methane, hydrogen, and a biogas; and a coated adsorbent comprising a porous adsorbent coated with a coating solution, wherein the gas is trapped in pores of the porous adsorbent.

11. The coated additive of claim 10, wherein the porous adsorbent comprises at least one of a metal-organic adsorbent, a carbon-based adsorbent, and a polymeric adsorbent.

12. The coated additive of claim 10, wherein the gas is trapped in the plurality of pores of the porous adsorbent with a weight ratio of between $1:10^6$ and 1:5 (gas:adsorbent).

13. A coated additive comprising:

a gas; and a coated adsorbent comprising a porous adsorbent coated with a coating solution, wherein the gas is trapped in pores of the porous adsorbent, wherein the coating solution comprises at least one of alginate, pectin, agarose, carrageenan, chitosan, carboxymethyl cellulose, and polyvinyl alcohol.

14. The coated additive of claim 10, further comprising a surfactant, the surfactant comprising at least one of oleic acid, oleylamine, polysorbate 20, sorbitan esters, octyl phenol ethoxylate, and glycerol.

15. The coated additive of claim 14, wherein a weight ratio of the surfactant to the adsorbent is between 0.1:1 and 5:1 (surfactant:adsorbent).

16. The coated additive of claim 13, wherein the gas comprises at least one of oxygen, methane, hydrogen, air, and a biogas.

17. The coated additive of claim 16, wherein the porous adsorbent comprises at least one of a metal-organic adsorbent, a carbon-based adsorbent, and a polymeric adsorbent.

18. The coated additive of claim 17, further comprising a surfactant, the surfactant comprising at least one of oleic acid, oleylamine, polysorbate 20, sorbitan esters, octyl phenol ethoxylate, and glycerol.

19. The coated additive of claim 10, wherein the gas further comprises air.

* * * * *